United States Patent [19]

Maxwell

[11] 4,106,200

[45] Aug. 15, 1978

[54] MARKER COMPASS

[76] Inventor: David Maxwell, 6035 Broadway, New York, N.Y. 10471

[21] Appl. No.: 774,751

[22] Filed: Mar. 7, 1977

Related U.S. Application Data

[63] Continuation-in-part of Ser. No. 654,210, Feb. 2, 1976, abandoned.

[51] Int. Cl.[2] ..... B43L 9/20; B43L 9/24

[52] U.S. Cl. ..... 33/27 B; 33/149 H

[58] Field of Search ..... 33/27 B, 149 H, 152 B, 33/153 AB, 154 AB

[56] References Cited

U.S. PATENT DOCUMENTS

| | | | |
|---|---|---|---|
| 322,865 | 7/1885 | Stuart | 33/152 B |
| 515,075 | 2/1894 | Deats | 33/152 B |
| 2,663,936 | 12/1953 | Lepkowski | 33/27 B |
| 3,020,641 | 2/1962 | Augustin | 33/27 B |
| 3,683,505 | 8/1972 | Graef | 33/27 B |
| 3,745,662 | 7/1973 | Gentils | 33/153 F |

FOREIGN PATENT DOCUMENTS

| | | | |
|---|---|---|---|
| 1,294,839 | 4/1962 | France | 33/27 B |
| 1,032,270 | 6/1953 | France | 33/27 B |
| 1,100,166 | 9/1955 | France | 33/27 B |

*Primary Examiner*—Charles E. Phillips

*Attorney, Agent, or Firm*—Kane, Dalsimer, Kane, Sullivan & Kurucz

[57] ABSTRACT

A marker compass assembly including a leg of fixed length. A cross-arm is pivotally mounted to one end of the leg. The other end of the leg is structured to facilitate positioning at a desired location on a surface to be marked. A retainer/cap is affixed to the end of the cross-arm distal from the leg and has a recess therein to receive and frictionally engage with either end of a marker body of fixed length. The leg has a predetermined length so that when the marker is held in the retainer/cap with the marker surface exposed and the leg is positioned at the desired location on the surface to be marked, the marker will be in position to mark the surface. Pivoting of the cross-arm will adjust the position of the marker tip relative to the positioned end of the leg on the surface thereby determining the radius of the arc that is to be drawn.

2 Claims, 14 Drawing Figures

20
22
24
26
28
30
32
34
36
38
40
41
42
44

MARKER COMPASS

CROSS REFERENCE TO RELATED APPLICATION

This application is a continuation-in-part of my previously filed application Ser. No. 654,210 filed Feb. 2, 1976 for Marker Compass, now abandoned.

BACKGROUND OF THE INVENTION

There are many different types of compasses available for inscribing circular arcs on surfaces. They are primarily designed for use with pencils and other marking instruments which vary in length. Accordingly they are designed to be adjusted to correspond to alterations in the marking structure. There is no known compass device which is specifically designed to be utilized for a specifically sized marker of the type which retains constant length. Conventionally this type of marker is the type which employs a fiber or plastic tip or similar material for transferring inks stored within the marker to a surface to be marked. Naturally this type of marker while retaining a constant length is also required to be captured within a housing and protected when not in use to prevent drying of the marking surface. Accordingly it would be helpful if the means for holding the marker when it is in use can be employed as a means for holding the marker when it is not in use and the tip is to be protected from drying out.

SUMMARY OF THE INVENTION

With the above background in mind, it is among the primary objectives of the present invention to provide a compass assembly which has a fixed size so as to be adapted for use with a single type of marking device of fixed length and, particularly, of the type which employs a marker tip of fiber or plastic material for applying a liquid ink from the marker to a surface. The compass is designed of simple and inexpensive construction and includes a leg of fixed length pivoted to a cross-arm which is attached to a retainer/cap for the marker body. The retainer/cap is provided with a recess having a configuration to receive a specific type and size of marker therein and hold it in frictional engagement therewith. The length of the leg is such that the marker tip will be aligned with the tip of the leg so that the chosen size marker will be accurately fitted to the compass. The retainer/cap of the compass is designed so that it can function as the holder for the marker when it is being utilized and as a receptacle for the marking tip of the marker in conventional fashion when the marker is not being utilized. Alternatively, the marker cap can be employed to cover the marking tip when not in use without having to remove the marker from the retainer/cap portion of the compass and reverse it.

In summary the marker compass assembly includes a leg of fixed length and a cross-arm pivotally mounted to one end of the leg. Means are at the other end of the leg to facilitate positioning of the leg at a desired location on a surface to be marked. A retainer/cap is affixed to the end of the crossarm distal from the leg and has a recess therein to receive and frictionally engage with either end of a marker body of fixed length. The leg has a predetermined length so that when the marker is held in the retainer/cap with the marker surface exposed and the leg is positioned at the desired location on a surface to be marked, the marker will be in position to mark the surface. Furthermore, the cross-arm will adjust the position of the marker tip relative to the positioned end of the leg on a surface thereby determining the radius of the arc that is to be drawn.

With the above objectives among others in mind, reference made to the attached drawings.

DESCRIPTION OF THE PREFERRED EMBODIMENTS

Figures 1, 2, 3, 4, 5:
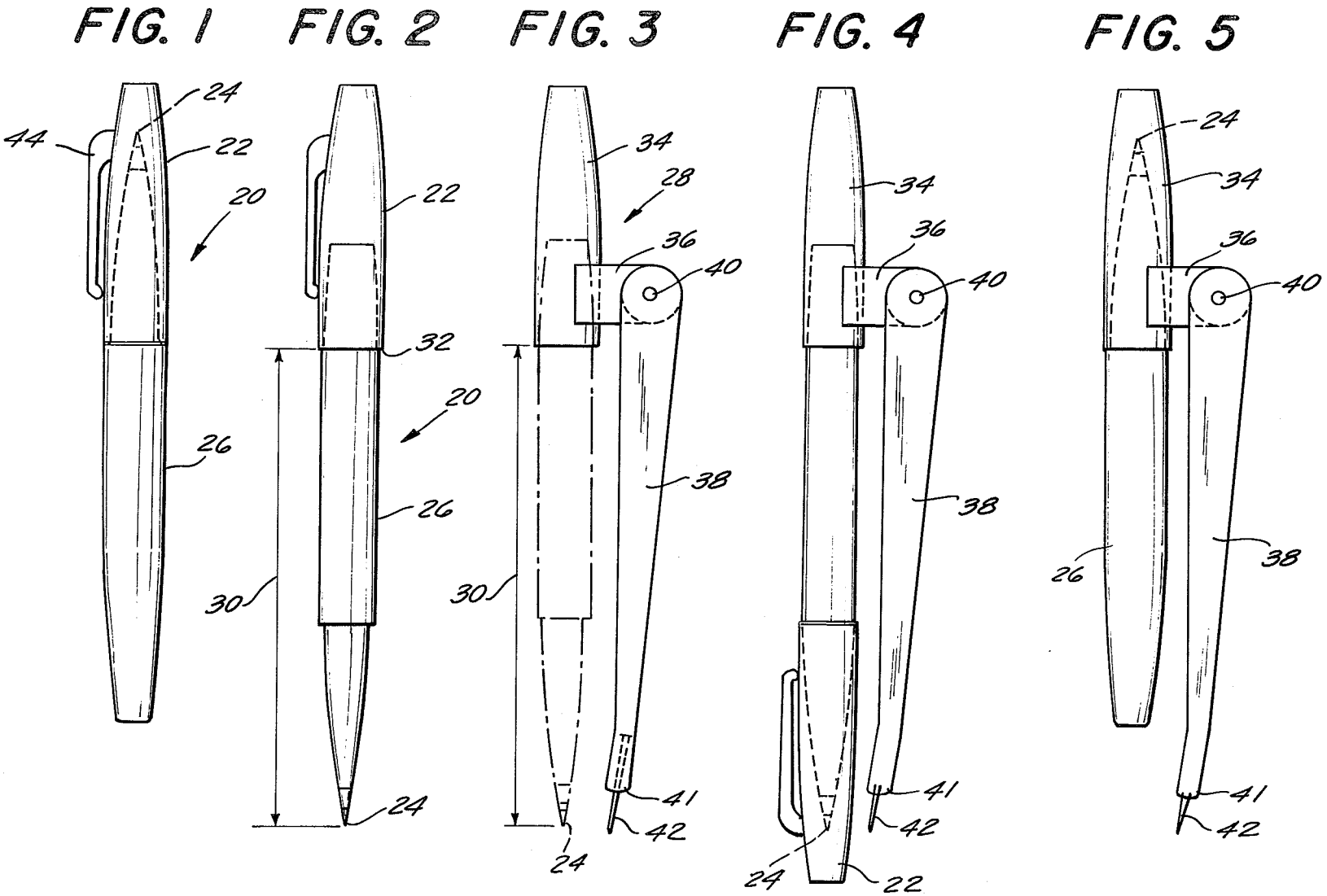
FIG. 1 is a side elevation view of a typical marker configuration showing the marker with its cap covering the writing tip.
FIG. 2 is a side elevation view thereof with the cap positioned on the marker barrel exposing the marker tip for use.
FIG. 3 is a side elevation view of the marker compass assembly of the invention with a marker barrel shown in phantom inserted in the retainer/cap portion of the assembly ready for use.
FIG. 4 is a side elevation view of the assembly of the invention with a marker in position in the retainer/cap and a separate marker cap covering the tip end when the marker is not in use.
FIG. 5 is a side elevation view of an alternative arrangement thereof with the retainer/cap of the marker compass assembly covering the marking end of the marker when it is not in use.

To fully appreciate the unique features of the proposed marker compass one must consider the disadvantages, limitations as well as the advantages of all existing fiber or plastic tip markers of the type to be used in the compass. FIG. 1 shows a representative marker 20 with a protective snap-on cap 22 that is an indispensable part of this type of pocket marker. Not only must it physically protect the marker tip 24 of the marker 20 but it must prevent the fluid marker ink from evaporating when the marker is not in use which would happen if the tip were exposed to air.

All inexpensive pencil compasses are meant to hold pencils which are smaller in cross-sectional diameter than the liquid-ink markers that now are presently in use. Even if these compasses were adapted to fit the larger diameter of markers, they would be unsuitable in their basic design in that they all grip the marker close to the tip in the cap area. This means that when not in use the marker would have to be removed from such a compass before the protective cap could be put in place. A further inconvenience is that when the marker is seated into a pencil-type compass, the process of aligning the marker tip and the compass point can be annoyingly time consuming.

FIG. 2 shows the marker 20 with the marker cap 22 having been removed from position on the marker barrel 26 covering the tip 24 and positioned on the opposite end of the barrel 26 and fixed in position by conventional frictional means. This exposes tip 24 for use. In this position, the cap 22 and the barrel 26 are joined in a firm frictional fit. This is an inherent feature in all good markers of this type and depends upon the tapered dimension on the rear end of barrel 26 in cooperation with the tapered inner bore of the cap 22. The frictional interengagement between cap and barrel is of significance when the barrel is applied to the compass marker assembly 28 of the invention as depicted in FIG. 3. Dimension 30 is the distance between the tip 24 and the point of frictional engagement between the rim 32 surrounding the entrance to the hollow interior of cap 22 and the tapered barrel 26 of the marker. This dimension 30 remains constant for a predetermined configuration of marker. Consequently, by predetermining this dimension in designing the configuration of the marker for use with compass assembly 28, it is possible to restrict the use of the compass to a desired brand or make of marker. This is due to the fact that unlike the point of a pencil which is constantly being worn down and then cut and sharpened in use, a marker point 24 does not significantly vary in length during the effective life of the marker. This advantage of marker vs. pencils, that is a constant dimension 30, is of considerable value in the control of the design of compass 28.

Furthermore, in writing all pencils require greater pressure then do markers. Colored pencils, especially, vary greatly as well as lead pencils in the required writing pressure. On the other hand markers require minimal writing pressure no matter what the color of their liquid inks. This fact makes the pivot of the marker compass 28 much simpler and eliminates the need to tighten and loosen the pivot every time the compass leg is extended or contracted.

In FIG. 3 marker compass assembly is depicted. It consists of a retainer and cap combination or a retainer/cap 34 of a plastic material or other convenient conventional material of metal or plastic. A cross-arm 36 is permanently affixed to the outer surface of retainer/cap 34 and may also be of a plastic material or other conventional substitute therefor. A compass leg 38 is joined to the cross-arm 36 at a pivot point 40. The leg 38 can also be of plastic or other conventional material as used for the cap and cross-arm. In a suitable aperture 41 at the lower end of the leg 38 a compass point 42 is inserted and is permanently locked in position by conventional means such as friction, cementing, thermal welding, or crimping. The compass point 42 can be of a conventional steel material or other well known substitutes therefor.

The size, shape and configuration of the retainer/cap 34 is similar and identical to the cap 22 of the marker 20 to be used. Naturally, the pocket clip 44 on cap 22 is not necessary for the retainer/cap 34 of compass 28. For use, all that is required is that the marker barrel 26 be inserted into the retainer/cap 34 firmly all the way for the retainer/cap 34 to grip and retain it securely by frictional interengagement in a similar manner as barrel 26 and cap 22 are coupled. A positive, non-wobbling and strong frictional hold is achieved, and no cams, levers or other conventional holding devices are necessary. The frictional interengagement is sufficient. Once the marker body 26 and the retainer/cap 34 are firmly joined, the distance 30 is the same as when the barrel 26 is coupled with its conventional cap 22. In this manner, the compass 28 is designed for use with a particular type, size and configuration of marker. The length and positioning of the cross-arm 36, the compass leg 38 and the compass point 42 can be fixed accurately and permanently in manufacture. This eliminates the need for any adjusting devices for the compass point 42 and the time consuming alignment of the marker tip 24 vis-a-vis the compass point 42. Other replacement markers in any color can be inserted and removed easily, quickly and accurately in the same manner that marker body 26, shown in phantom in FIG. 3, is coupled with compass 28.

When the compass 28 is not being used, marker body 26 can be removed from the compass and its own cap 22 can be used to protect the tip end as shown in FIG. 1. Alternatively, it could be left in place in the compass 28, as shown in FIG. 4 and its own marker cap 22 can be affixed to protect the top 24. A further alternative is shown in FIG. 5. The marker could be reversed and tip 24 inserted and snapped into the retainer/cap 34 of the marker compass 28. In this form, marker cap 22 can be discarded. This arrangement can be accomplished since the retainer/cap 34 of the marker compass 28 is essentially the same as the marker cap 22. Accordingly, the retainer/cap 34 of the compass 28 will protect the integrity of the marker tip 24 as efficiently as its unused original cap 22.

The present marker compass is designed for use with the conventional type of writing marker which is commonly called an office or desk-type marker. The present structure incorporates a conventional marker as part of an integral structure without the necessity of a change or alteration in dimension of the marker. Examples of the type of marker under consideration are those manufactured by Faber Castell Company of Newark, New Jersey and identified by the names WONDER WRITER, ESTERBROOK and ROUGUE; Berol Company of Danbury, Connecticut and identified by the names EAGLE, ALL-RITE, and FLASH-30; Gillette Company of Boston, Massachussets and identified by the names FLAIR and PAPER MATE; Eberhardt Faber of WilksBarre, Pennsylvania and identified by the name DART; National Pen and Pencil Company of Shelbyville, Tennessee and identified by the name TUCKER. All of these markers fall within a general conventional dimension range and can be used without alteration as part of the compass marker structure. They all have an outside diameter on the end portion of the cap adjacent to rim 32 in the range of 26 – 29 64ths of an inch and an exposed length 30 of barrel 26 in the in use position in the cap, as depicted in FIG. 3, in the range of 3 and 14/16ths inches – 4 and 9/16ths inches. The following chart shows these dimensions for the above identified conventional markers.

| MARKER | O.D. in 64ths | L. in.-16ths |
|---|---|---|
| WONDER WRITER | 29 | 3–14 |

-continued

| MARKER | O.D. in 64ths | L. in.-16ths |
|---|---|---|
| ESTERBROOK | 29 | 3–14 |
| ROUGUE | 29 | 3–14 |
| FLAIR | 28 | 3–14 |
| DART | 27 | 4–7 |
| EAGLE | 27 | 4–9 |
| PAPER MATE | 28 | 3–14 |
| TUCKER | 26 | 3–14 |
| ALL-RITE | 29 | 4–6 |
| FLASH-30 | 29 | 4–6 |

There is sufficient tangency and length on the cap of the above markers for adequate surface to surface engagement to mount the cross-arm 36 in position on the cap and form the marker compass 20. Thus, there is a range of conventional markers that can be used without alteration as part of the present marker compass 20. The resilience of the plastic cross-arm 36 and of the plastic cap of these markers facilitates interconnection and aids in making the difference in dimensions unconsequential. Furthermore, the cross-arm can be mounted at different points along the length of the cap to accommodate the small length differences of the above markers.

Figure 8A:
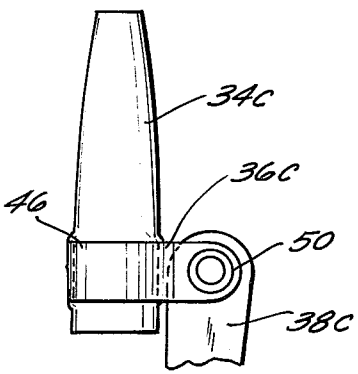
FIG. 8A is a fragmentary side elevation view of a second alternative embodiment for connecting the retainer/cap to the cross arm of the assembly.
Figure 8B:
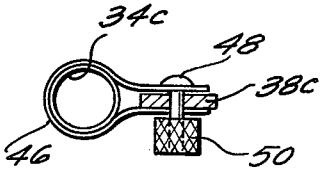
FIG. 8B is a sectional top view of the embodiment of FIG. 8A.
Figure 7A:
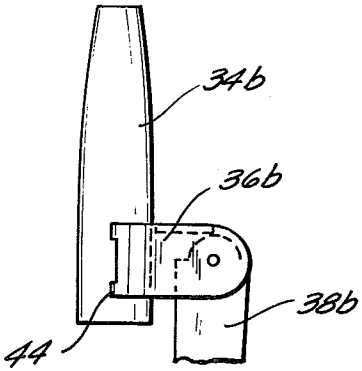
FIG. 7A is a fragmentary side elevation view of an alternative form for interconnecting the retainer/cap portion of the assembly to the cross arm.
Figure 7B:
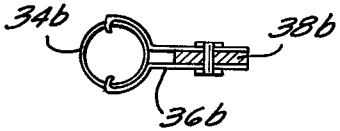
FIG. 7B is a sectional top view of the assembly of FIG. 7A.
Figure 6A:
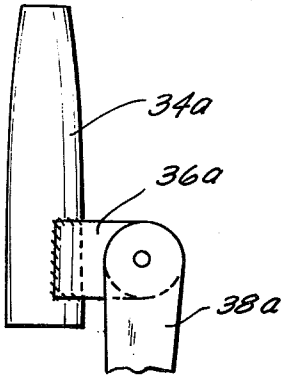
FIG. 6A is a fragmentary side elevation view of the assembly of the invention showing a first means for fastening the retainer/cap to the cross arm portion thereof.
Figure 6B:
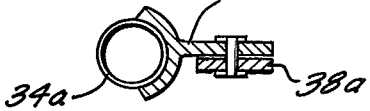
FIG. 6B is a sectional top view of the embodiment depicted in FIG. 6A.

FIGS. 6A, 6B, 7A, 7B, and 8A, 8B show alternative forms of the cross-arm and the means for attaching the alternative forms to the retainer/cap 34. In FIGS. 6A and 6B the cross-arm 36*a* is made of plastic and is attached to the retainer/cap 34 by a suitable quick-acting plastic cement, or it can be attached by thermal welding or any other convenient process of plastic technology. In FIGS. 7A and 7B, the cross-arm 36*b* is fabricated of a single piece of sheet metal stamped with lugs 44. It is then folded and shaped to fit the retainer/cap 34*b*. The retainer/cap 34*b* for this embodiment is punched with appropriate slots to fit the lugs 44. These lugs are then inserted and clinched firmly to the retainer/cap 34*b*. The compass leg 38*b* is shaped and fitted to fit into the two cheeks of the metal cross-arm 36*b*. In FIGS. 8A and 8B, the cross-arm 36*c* is formed of a piece of sheet metal that is shaped to fit the retainer/cap 34*c*. Retaining lugs 46 are molded on the retainer/cap 34*c* to keep the metal cross-arm 36*c* from slipping up or down on the vertical axis of the retainer/cap 34*c*. The compass leg 38*c* is slipped into the outer portions of the cross-arm 36*c* and is joined by bolt 48 and is tightened by a knurled finger nut 50 thus also achieving a firm pivot. Instead of utilizing molded lugs 46 in the retainer/cap 34*c*, another alternative would be to pierce the cross-arm 36*c* with triangular "fingers" bent inward to bite into the plastic retainer cap 34*c* to keep the sheet metal cross-arm 36*c* from slipping up or down along the vertical axis of the cap 34*c*.

Figure 9:
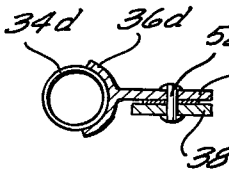
FIG. 9 is a sectional top view of the marker compass assembly of the invention showing alternative means for forming the pivot.
Figure 10:
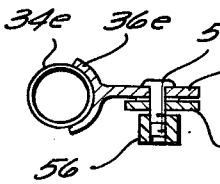
FIG. 10 is a top sectional view of the marker compass assembly and a second alternative type of pivot.
Figure 11:
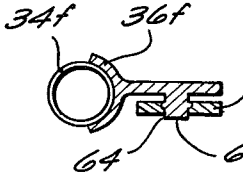
FIG. 11 is a sectional top view of the marker compass assembly of the invention showing still another alternative pivot.

FIGS. 9, 10 and 11 are alternative means of making the pivot connection between the cross-arm and the compass leg. They are horizontal cross-sections taken through the retainer/cap, cross-arm and compass leg assembly of FIG. 3. Cross-arms 36*d* of FIG. 9 and 36*e* of FIG. 10 are alike and are fastened permanently to the respective retainer-caps 34*d* and 34*e*. In FIG. 9, the cross-arm 36*d* is attached to the compass leg 38*d* by a metal rivet 52. In FIG. 10 the cross-arm 36*e* and the compass leg 38*e* are connected by a threaded bolt 54 and an interconnected knurled finger nut 56. In the embodiments of FIGS. 9 and 10, if the kind of plastic used is too slippery, a friction or slip-ring washer 58 and 60 respectively can be introduced to make a firmer pivot.

In FIG. 11, the cross-arm 36*f* is permanently attached to the retainer-cap 34*f*. At the pivot point of the cross-arm 36*f*, a projection 62 with an annular ring is molded. A receptacle hole 64 is molded into the compass leg 38*f*. Both pieces are then forced together to form a firm pivot with necessary frictional drag. Because a marker writes with minimal pressure, the pivot on a marker compass would not need the intense adjustable torque pressure of the pivot on a pencil compass with its greater required writing pressure. The choice of which of the pivots of FIGS. 9, 10 and 11 or any other substitute therefore are to be employed is one to be determined by convenience of the equipment available to the manufacturer. For purposes of the primary discussed embodiment of FIGS. 1–5 the pivot arrangement of FIG. 9 is employed for formation of pivot 40. Naturally it can be readily observed how either of the other two depicted and described alternatives can be substituted therefore.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A marker compass assembly comprising:

A leg of fixed length, a resilient plastic cross-arm pivotally mounted to one end of the leg with a limited amount of frictional interengagement therebetween so that they retain their respective positions unless subjected to a predetermined amount of force, means at the other end of the leg to facilitate positioning of the leg at a desired location on a surface to be marked, a resilient plastic retainer/cap affixed to the end of the cross-arm distal from the leg and having a closed end and a tapered recess in the other end, the surfaces forming the recess having a larger diameter at the point distal from the closed end and gradually tapering toward the closed end, the retainer/cap having a generally cylindrical external configuration and dimensionally conforming to the shape and size of a cap for a conventional size, hand-held, desktype writing marker, the cross-arm due to its resilience can be coupled with a variety of different size conventional retainer/caps without alteration in structure of the cross-arm or the retainer/caps, a conventional size, hand-held, desk-type writing marker body of fixed length and generally cylindrical configuration containing marking material subject to relatively rapid evaporation, the marker body having a closed end and a writing tip at the other end, the marker body requiring substantially zero force to accomplish the writing function when the tip is applied to the writing force, the marker body being reversably mounted in the recess of the retainer/cap and having tapered surfaces on both ends of the marker body generally conforming to the tapered recess to permit tight frictional interengagement therebetween, whereupon insertion of the closed end of the marker body into the recess will produce automatic retention of the marker body in position for use as part of the marker compass with the writing tip exposed and in fixed position for use and, reversal of the marker body and insertion of the writing tip into the retainer/cap will produce automatic retention of the marker body in position for sealing protection of the writing tip when not in use to avoid evaporation of the marking material without the necessity of an additional protective cap, the leg having a predetermined length corresponding to the length of the marker body when the marker body is held in the retainer/cap with the tip exposed so that when the leg is positioned at the desired location on the writing surface the marker tip will be in position to write on the surface and application of the predetermined amount of force to pivot the cross-arm will permit adjustment of the marker tip relative to the positioned end of the leg on the surface thereby determining the radius of the arc that is to be drawn, and a limited amount of frictional interengagement being adequate to retain the relative pivotal position of the marker body with respect to the leg during rotation of the marker compass since no force need be applied to the marker tip for writing purposes during use.

2. The invention in accordance with claim 1 wherein the outer diameter of the retainer/cap at a point adjacent the other end thereof is in the range of 25 64ths of an inch – 30 64ths of an inch and the length of the exposed portion of the marker when the marker is fixed in position in the retainer/cap for use is in the range of 3 and 12/16th inches – 4 and 10/16ths inches.

* * * * *